US006254440B1

(12) United States Patent
Ko et al.

(10) Patent No.: US 6,254,440 B1
(45) Date of Patent: Jul. 3, 2001

(54) TERMINAL HAVING CONTACT PORTION WITH REDUCED THICKNESS

(75) Inventors: David Tso-Chin Ko, Thousand Oaks, CA (US); Dick Lee, Tao Yuan (TW); Eric Juntwait, Irvine, CA (US); Yun-Fu Tsai, Tu Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/207,083

(22) Filed: Dec. 7, 1998

(51) Int. Cl.[7] ..... H01R 11/22; H01R 13/11

(52) U.S. Cl. ..... 439/857

(58) Field of Search ..... 439/856, 857, 439/81, 636, 637, 885

(56) References Cited

U.S. PATENT DOCUMENTS

| | | | | |
|---|---|---|---|---|
| 2,490,631 | * | 12/1949 | Johansson | 439/857 |
| 3,812,452 | * | 5/1974 | Sturm | 439/857 |
| 4,776,651 | * | 10/1988 | Paulo | 439/857 |
| 5,051,099 | * | 9/1991 | Pickles et al. | 439/108 |
| 5,183,421 | * | 2/1993 | Yin | 439/857 |
| 5,551,883 | * | 9/1996 | Davis | 439/636 |
| 5,865,649 | * | 2/1999 | Yu et al. | 439/637 |
| 5,897,394 | * | 4/1999 | Adachi | 439/857 |

* cited by examiner

*Primary Examiner*—Neil Abrams
*Assistant Examiner*—Javaid Nasri
(74) *Attorney, Agent, or Firm*—Wei Te Chung

(57) ABSTRACT

A connection terminal for use with a flat flexible connector comprises a base defining first and second sides. A pair of cantilevered arms extends forward from the base. Each arm forms a contact portion at a free end thereof. Characterized in that the contact portion has reduced thickness than the rest of the terminal.

7 Claims, 4 Drawing Sheets

TERMINAL HAVING CONTACT PORTION WITH REDUCED THICKNESS

FIELD OF THE INVENTION

The present invention relates to a method, and particularly to a method for making low-friction electrical connection element. The contact portion has a reduced thickness thereby providing a burr-free face during stamping process.

DESCRIPTION OF THE PRIOR ART

Flat flexible cable or flexible printed circuits includes a plurality of parallel spaced electrical conductors. Connectors for connecting the individual flexible cable to printed circuit board are known to skilled in the art. The connector used to connect the cable to a printed circuit board includes housing defining a cavity for arranging an array of terminals. Each terminal includes a connecting portion for connecting a corresponding conductor of a flat flexible cable. The terminal typically includes a base portion having a pair of upper and lower arms cantilevered from the base portion. A gap is defmed between the upper and lower arms for entrance of the conductor. The size of the gap is slightly small than a thickness of the conductor, accordingly, when the conductor is inserted, a normal force generated thereof ensures the electrical connection therebetween.

U.S. Pat. No. 4,808,113 issued on Feb. 28, 1989 to Kanesige et al discloses a flat flexible cable suitable for surface mounting. U.S. Pat. No. 5,401,186 issued on Mar. 28, 1995 to Nozaki et al discloses an electrical connection element with a widened contact span. The connection element includes a first and second edge portions bent laterally. By the provision of widened connection surface, even the conductors are slightly and randomly arranged, effective electrical connection therebetween can still be ensured. However, even a plurality of patents have issued, none addresses to frictional force between the contact portion of the terminal and the conductor of the flat flexible cable.

Basically, connection terminals are manufactured from a material sheet through stamping process. The thicker the thickness of the material is, the higher the normal force may generate. However, material sheet of higher thickness generates burr on edge of a terminal 50 after stamping, as shown in FIG. 1. Each burr 51 is a sharp cutter which wears off the conductor 20 when connected thereto. Additionally, burrs increase frictional force tremendously, almost three times. Conventionally, burrs are removed by polishing and this inevitably increases the manufacturing cost.

SUMMARY OF THE INVENTION

An objective of this invention is to provide a method for producing a low frictional force connection terminal which is free from burrs during stamping process thereby reducing frictional force.

In order to achieve the objective set forth, the method in accordance with the present invention comprises the steps of 1) providing a material sheet of a first thickness and having a first and second sides; 2) defining a second thickness along the first side; 3) stamping the material sheet to form a plurality of connection terminals.

According to one aspect of the present invention, wherein a contact portion is formed on the first side.

A connection terminal for use with flat flexible connector comprises a base defining a first and second sides, a pair of cantilevered arms extending forward from one of said first and second sides, an end edge of one of first and second arms forming a contact portion, characterized in that the contact portion has reduced thickness than the rest of the terminal.

According to another aspect of the present invention, wherein the first and second arms are convergent to each other.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
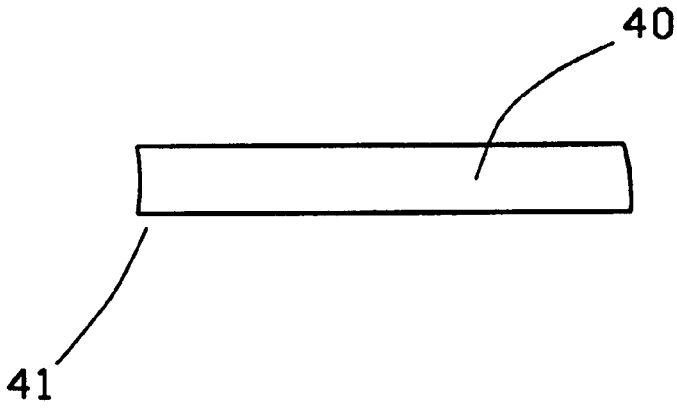
FIG. 1 is a side elevational view of a contact portion having burrs formed during stamping process.
Figure 2:
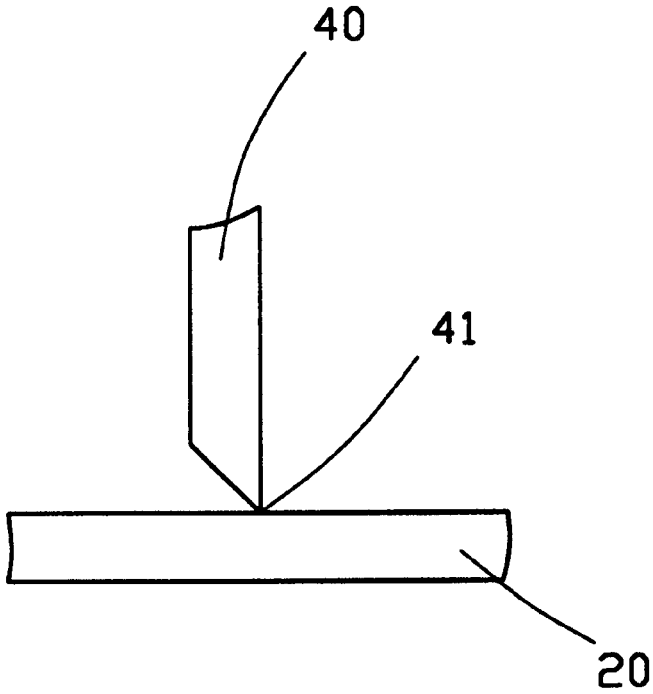
FIG. 2 is end view of the contact portion of FIG. 1 showing a conductor is worn by the burrs.
Figure 3:
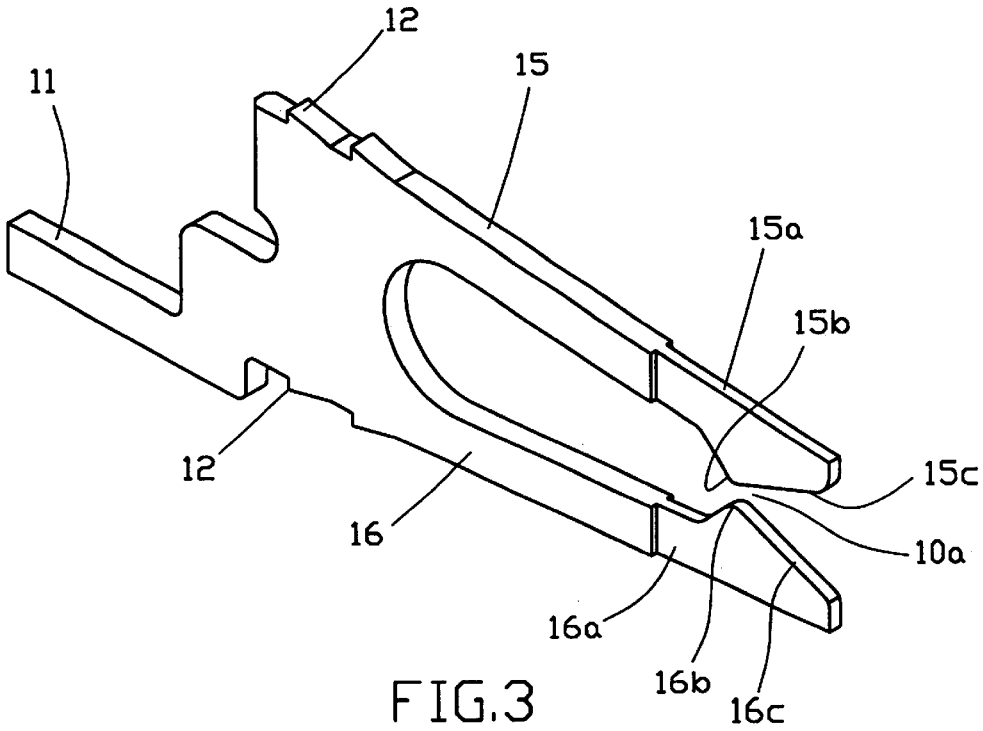
FIG. 3 is a perspective view of a terminal in accordance with the present invention.
Figure 4:
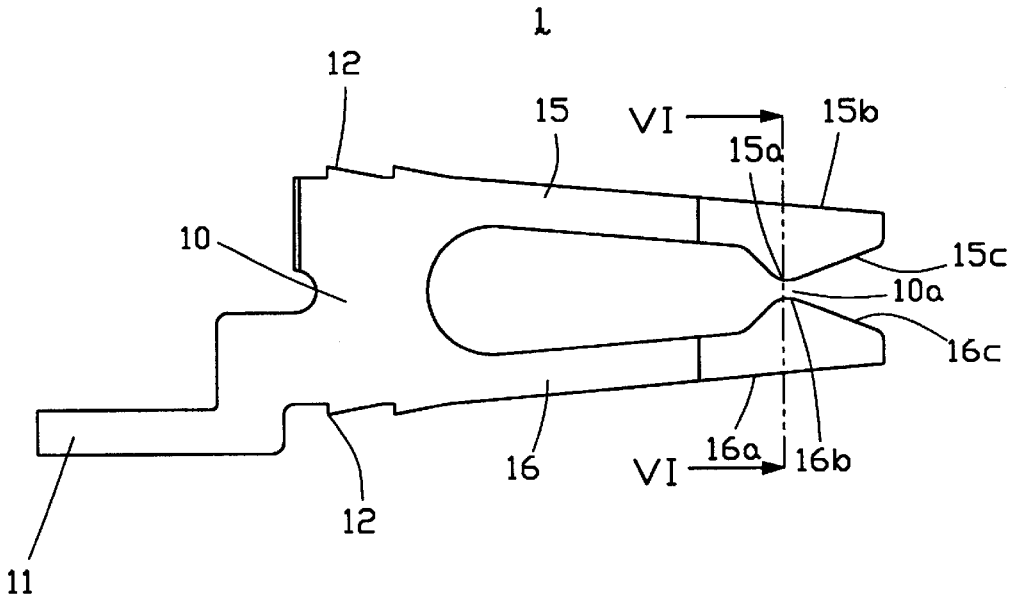
FIG. 4 is a top plan view of FIG. 3.
Figure 5:
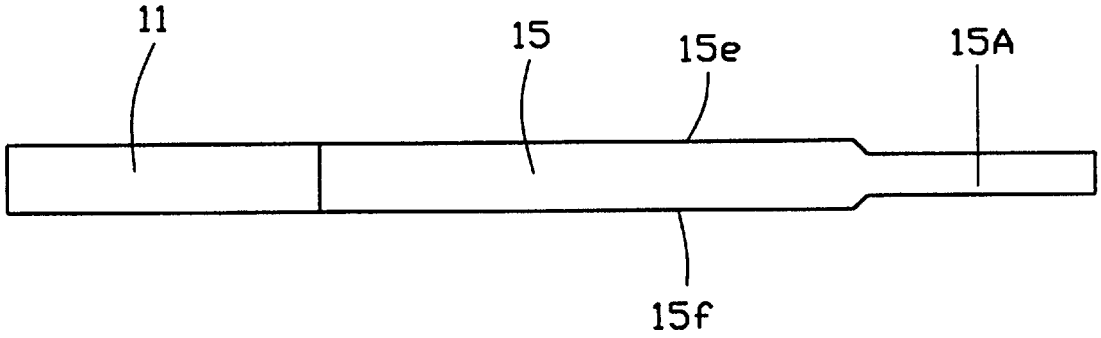
FIG. 5 is a side elevational view of FIG. 3.

Referring to FIGS. 3 and 4, a plate-like connection terminal 1 in accordance with the present invention generally comprises a base 10 for securely received within a passageway of a housing (not shown). The base 10 forms a solder tail 11 for electrically connecting to a lead of a printed circuit board (not shown). Sides of the base 10 are formed with barbs 12 which increase retention in the passageway.

A first arm 15 is cantilevered from the base 10. The first arm 15 forms a contact portion 15 *a* at a free end thereof. The first contact portion 16*a* forms a first projected embossment 15*b* extending forward.

Figure 6:
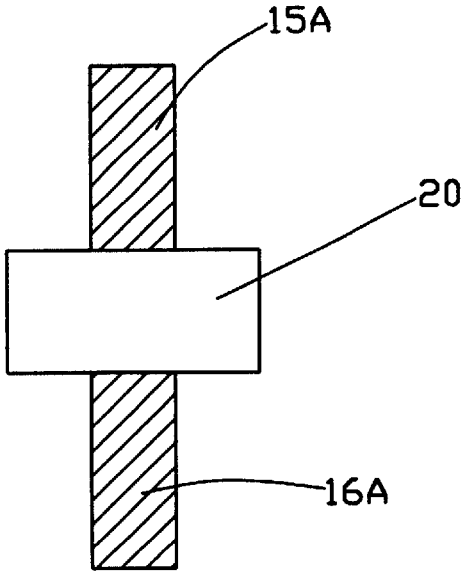
FIG. 6 is a cross sectional view taken along line VI—VI of FIG. 4.

A second arm 16 is cantilevered from the same end of the base 10. The second arm 16 forms a second contact portion 16*ab* at a free end thereof. The second contact end 16*a* forms a second projected embossment 16*b* extending torward to the first contact portion 15*a* . A receiving gap 1O*a* is defined between the first and second embossments 15*b* , 16*b* . By this arrangement, a conductor 20 of a flat flexible cable can be electrically received between the gap 1O*a*, FIG. 6. Since the embossments 15*b* , 16*b* are free from burrs, the conductor 20 will not be easily worn off.

According to preferable embodiment of the present invention, longitudinal directions of the first and second arms 15, 16 are convergent and this benefits higher normal force on the contact portions 15*a*, 16*a*. Additionally, each contact end 15*a* , 16*a* has an inclined leading face 15*c*, 16*c* which facilitate easy insertion of the conductor 20.

Figure 7:
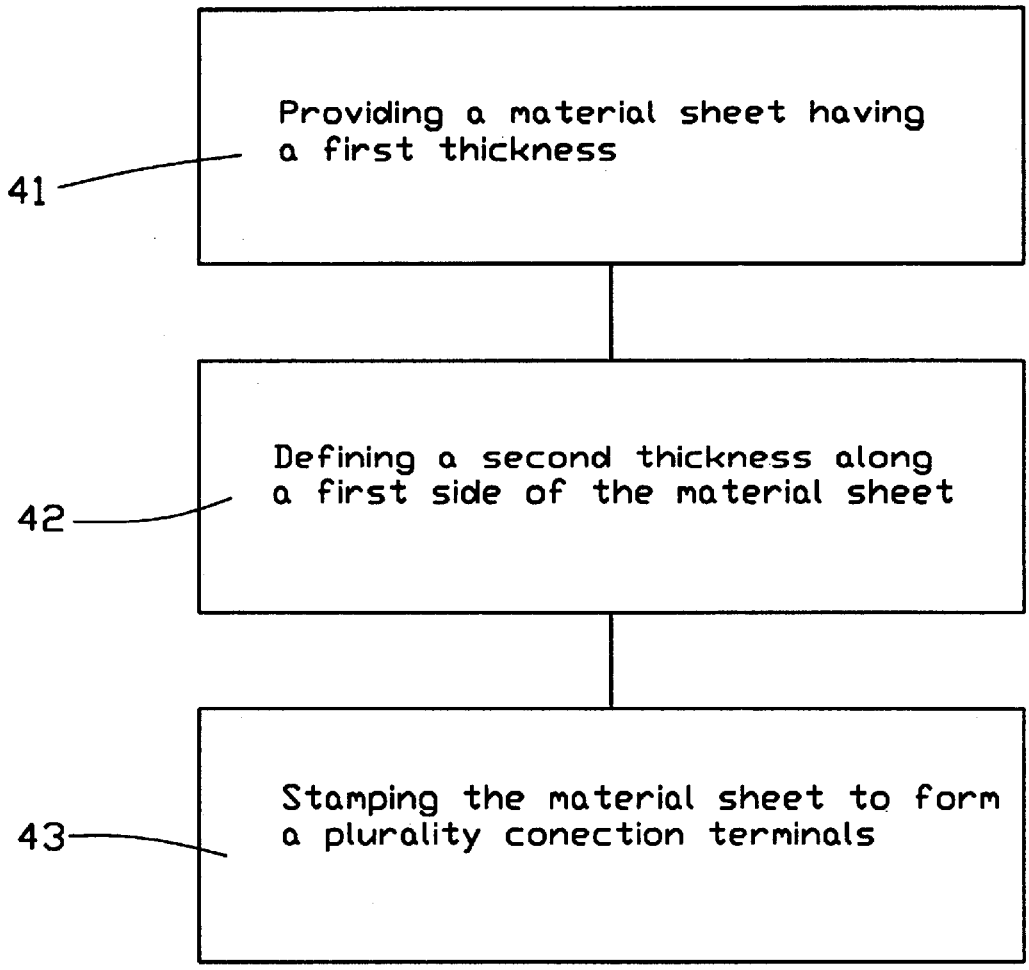
FIG. 7 is a flow chart of the manufacturing process.
Figure 8:
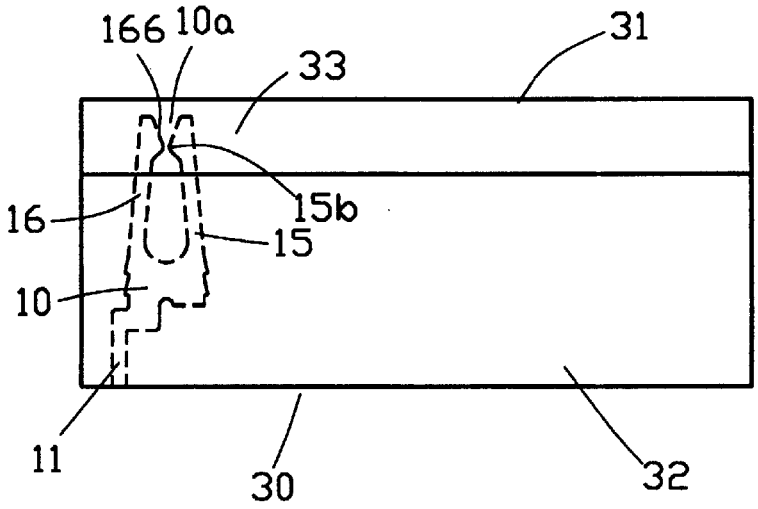
FIG. 8 is sketch view showing the connection terminals are stamped from a metal sheet.

FIG. 7 is a flow chart of manufacturing process for producing the terminal 1 from a material sheet 30. The steps comprises 1) the step 41 of providing a material sheet of a first thickness and having a first and second sides 41; 2) the step 42 of defining a second thickness along the first side; and 3) the step 43 of stamping the material sheet to form a plurality of connection terminals.

According to the method mentioned above, a material sheet 30 used for producing terminals 1 has a first and second sides 31, 32. An elongate area 33 of reduced thickness is defined along the first side 31. When the material sheet 30 is undergone the stamping process, contact ends 15*a*, 16*a* are formed thereon. Since the thickness in the area 33 is reduced, no burrs will be formed during stamping process. Therefore benefits smooth embossments 15*b*, 16*b* thereon. By this arrangement, no further polishing procedures are required. The electrical properties are also improved.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. A connection terminal for use with flat flexible connector, comprising:

a base defining first and second sides;

a pair of cantilevered arms extending forward from one of said first and second sides of said base, one arm of said pair of cantilevered arms forming a first contact portion at a free end thereof, characterized in that the contact portion has uniformly reduced thickness than the rest of said one arm, and said uniformly reduced thickness is formed by symmetrically reducing upper and lower surfaces of said one arm.

2. The connection terminal as recited in claim 1, wherein said second arm forms a second contact portion jointly defining a gap with said first contact portion.

3. The connection terminal as recited in claim 2, wherein said second contact portion has a thickness same to the thickness of said first contact portion.

4. The connection terminal as recited in claim 2, wherein each first and second contact portion includes an embossment extending toward each other.

5. The connection terminal as recited in claim 1, wherein said first and second arms are convergent to each other.

6. A plate-like terminal, comprising:

a base defining a first side and a second side thereof;

a cantilevered arm extending from one of said first and second sides and away from the other of said first and second sides; and a contact portion formed at a distal end of said cantilevered arm; wherein a uniform thickness of said contact portion is smaller than thickness of rest of said cantilevered arm, wherein said uniformly reduced thickness is formed by symmetrically reducing upper and lower surfaces of said cantilevered arm.

7. The terminal as recited in claim 6, wherein the terminal is stamped from a material sheet having different thickness thereof to respectively form the contact portion and rest of terminal.

* * * * *